United States Patent [19]

Martin

[11] Patent Number: 4,762,222

[45] Date of Patent: Aug. 9, 1988

[54] CONTAINER CONSTRUCTION PARTICULARLY FOR AMMUNITION

[75] Inventor: Roland Martin, Würnberg, Fed. Rep. of Germany

[73] Assignee: DVG Deutsche Verpackungsmittel GmbH, Fed. Rep. of Germany

[21] Appl. No.: 911,066

[22] Filed: Sep. 23, 1986

[30] Foreign Application Priority Data

Oct. 25, 1985 [DE] Fed. Rep. of Germany ..... 3538027

[51] Int. Cl.[4] ..... F42B 37/00

[52] U.S. Cl. ..... 206/3; 206/594; 220/410; 285/321

[58] Field of Search ..... 206/3, 509, 521, 594; 220/410, 468; 285/321; 89/7, 34, 36.01, 36.17

[56] References Cited

U.S. PATENT DOCUMENTS

| | | | |
|---|---|---|---|
| 1,988,034 | 1/1935 | Dolan | 206/3 |
| 2,308,480 | 1/1943 | Abbott et al. | 206/3 |
| 2,351,804 | 6/1944 | Blum | 206/3 |
| 2,722,307 | 11/1955 | Burke et al. | 206/3 |
| 2,812,958 | 11/1957 | Rogers | 285/321 |
| 3,465,871 | 9/1969 | Lyons et al. | 206/3 |
| 3,667,785 | 6/1972 | Kapeker | 285/321 |
| 4,279,339 | 7/1981 | Gotter | 206/3 |
| 4,356,913 | 11/1982 | Moraine | 206/523 |
| 4,611,837 | 9/1986 | Aleck | 285/321 |

FOREIGN PATENT DOCUMENTS

| | | | |
|---|---|---|---|
| 535303 | 4/1941 | United Kingdom | 206/3 |

*Primary Examiner*—David T. Fidei

*Attorney, Agent, or Firm*—McGlew and Tuttle

[57] ABSTRACT

In a container, in particular munitions container, an outer jacket is provided with an inner lining. To retain the inner lining in the outer jacket a bead, concave as viewed from the inside, circles the outer jacket and an elastic safety ring is inserted in the bead.

8 Claims, 1 Drawing Sheet

CONTAINER CONSTRUCTION PARTICULARLY FOR AMMUNITION

FIELD AND BACKGROUND OF THE INVENTION

The invention relates in general to ammunition handling and in particular to a new and useful container to accept a part, in particular ammunition, and having an outer jacket with an inner lining and a stop provided on the inside of the outer jacket.

A similar munition container is described in German OS No. 30 02 284. Therein, a stationary collar is provided on the inner periphery of the outer jacket. It serves primarily to support a piston-like cover which is automatically discharged from the outer jacket upon release. The collar itself is a hindrance to inserting the inner lining into the outer jacket. Since the inner lining is formed of elastic pads it is possible nevertheless to insert the inner lining into the outer jacket. An inner lining whose shape is stable could not be pushed over the collar.

Described in German OS No. 29 10 126 is a munition container with a sheet metal outer jacket on which a circular bead is provided. As viewed from the inside, the bead is convex so as to project inwardly. An inner lining stable in shape could therefore not be inserted into the outer jacket. A ring, serving merely to align the munition radially, is placed on the bead.

SUMMARY OF THE INVENTION

The invention provides a container with a dimensionally stable inner lining which can be pushed flush inro the outer jacket without the possibility of the inner lining being pulled out of the outer jacket unintentionally with the stored part, or falling out of the opened container.

According to the invention, a container as viewed from the inside is provided with a concave bead which encircles the outer jacket and an elastic safety ring which projects inwardly beyond the bead and forms the stop for a face edge of the inner lining and are inserted in the bead.

The bead is no hindrance for the insertion of the inner lining. Therefore, the inner lining can be dimensionally stable and have an outside diameter equaling the inside diameter of the outer jacket. After the insertion of the safety ring, the inner lining can no longer be shifted axially in the outer jacket so that it will not be pulled out unintentionally when the part accommodated in the container is taken out. On the other hand, after the removal of the safety ring, the inner lining can be pulled out of the outer jacket. This may become necessary, for example, in order to repair the inner lining, or to clean it, or to replace it by another inner lining to package another part.

In a preferred embodiment of the invention, the safety ring comprises rubber. A rubber of a Shore hardness of 80° to 90° has proven to be advantageous. However, the safety ring may also be a steel snap ring or a plastic ring.

The invention makes glueing the inner lining to the outer jacket unnecessary. Different coefficients of expansion of the outer jacket and the inner lining do not impair the support of the inner lining in the outer jacket. The outer jacket may be of plstic or sheet metal. The inner lining is advantageously wound of cardboard, or made of another material such as plastic, metal or wood.

The exchangeability of the inner lining also makes it possible to equip the outer jacket selectively with different inner linings to match the shapes of the munitions.

Accordingly it is an object of the invention to provide a container of a type for holding and storing, particularly ammunition which includes a cylindrical jacket having a lining disposed within the jacket with an end face which is spaced from the top of the cylinder and an opposite end face which rests on the bottom and including a bead which encircles the jacket and forms a cavity extending outwardly from its interior wall and which carries a safety ring which projects into the interior sufficiently to hold the lining in place. The consruction further advantageously includes a further lining arranged on the interior of the first lining which defines an end stop with its end face adjacent the bottom. A part such as a round of ammunition is positioned in the jacket after its inner end has been wrapped with a resilient pad which abuts against the end face of the additional lining. A cover for the jacket closes off the top and holds a resilient pad against the part which is stored therein.

A further object of the invention is to provide a container for a part such as a round of ammunition which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
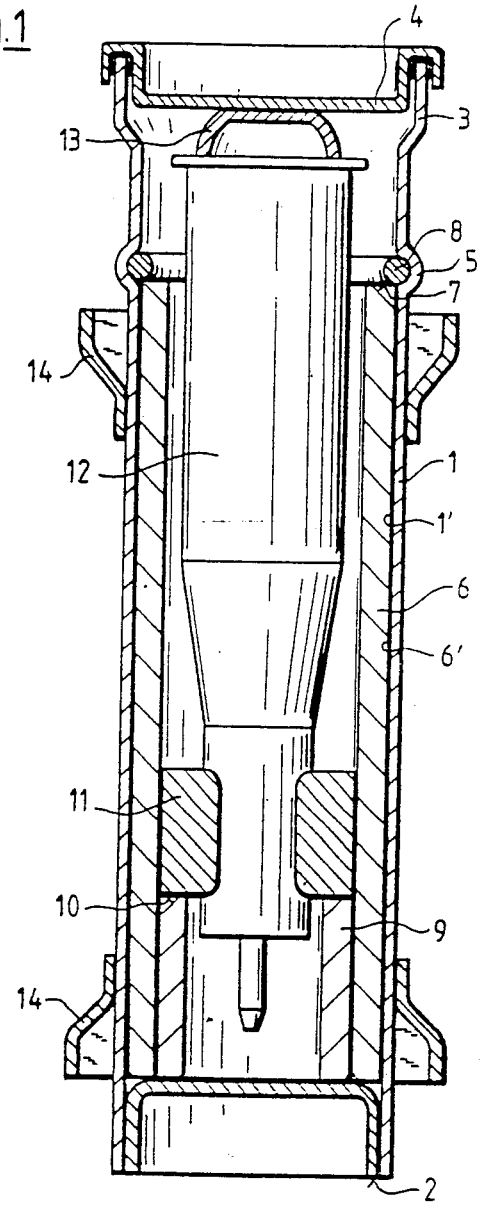
FIG. 1 is an axial sectional view of a container constructed in accordance with the invention provided for storing a single round of ammunition; and FIGS. *2a*, *2b* and *2c* are partial sectional views showing various embodiments of bead and safety ring constructions for other embodiments of the invention.
Figure 2A:
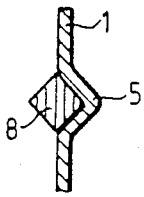
Figure 2B:
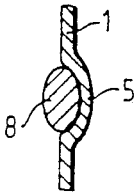
Figure 2C:
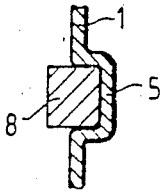

Referring to the drawings in particular, the invention embodied therein comprises a container 1 for holding a part such as a round of ammunition 12 which is first provided with a plastic ring 11 which is held by a reduced diameter portion of the part 12.

A cylindrical outer jacket 1 is made of sheet metal. In it is welded a bottom 2. At its end opposite the bottom 2 the outer jacket 1 has an expanded area 3 which acommodates a removable cover 4.

A bead 5 is formed on the outer jacket 1 near the expanded area 3. As viewed from inside the containe, this bead is concave, therefore, it does not project inwardly beyond the inside diameter 1' of the outer jacket.

Inerted as inner lining in the outer jacket 1 is a tube 6 which is advantageously a wound cardboard, plastic, wood or metal. Its outside diameter 6' corresponds to the inside diameter 1' of the outer jacket 1. The tube 6 thus is in close contact with the outer jacket 1. The tube 6 rests on the bottom 2. Its face 7 opposite the bottom 2 is near the bead 5. Snapped into the bead 5 is an elastic safety ring 8 which advantageously comprises a rubber of a Shore hardness of 80° to 90°. The safety ring 8 projects on the inside beyond the inside diameter 1' so that it forms a stop for the end face 7 of the tube 6. Preferably, the safety ring 8 projects by half its cross section (see FIGS. 1, *2a*, *2b*, *2c*).

A tube 9 of material the same as or similar to the tube 6 is glued into the cardboard tube 6 in the area near the bottom. Its end face 10 forms a stop for split plastic ring 11 which engages in form-closing fashion on a recess in a munitions part 12. The munitions part 12 is supported by the cover 4 via a pad 13.

To equip the container, the cardboard tube 6 with the piece of tube 9 is pushed into the outer sheet metal jacket 1 to the bottom 2. Then the safety ring 8 is snapped into the bead 5 so that the cardboard tube 6 can no longer slide out of the outer jacket 1. The container is now ready to receive the munitions parts 12 provided with the plastic ring 11. After it and the pad 13 are inserted, the cover 4 is closed. The plastic ring 11 is thereby pushed against the face 10, whereby the munitions part 12 is safely retained in the container.

If the munition 12 is pulled out after removal of the cover 4, the plastic ring 11 goes along, but not the cardboard tube 6 and the piece of tube 9.

If, in special cases, the cardboard tube 6 with the piece of tube 9 is to be removed also, the safety ring 8 is taken out of the bead 5, whereupon the cardboard tube 6 can be pulled out of the outer jacket 1.

In the embodiment example acording to FIG. 1, the safety ring 8 is of circular section and, accordingly, the bead 5 is of semicircular section.

In the embodiment according to FIG. *2a*, the safety ring 8 is of rectangular section, and the bead 5 has a triangular, V-shaped section.

In the embodiment example according to FIG. *2b*, the section of the safety ring 8 is lentil-shaped. The bead 5 is correspondingly flat.

In the embodiment example according to FIG. *2c*, the section of the safety ring 8 is rectangualr and that of bead is U-shaped.

Square sections 14 are fastened to the outside of the sheet metal jacket 1 to help stack the cylindrical containers.

While specific embodiments of the invention have been shown and described in detail to illustrate the application of the principles of the invention, it will be understood that the invention may be embodied otherwise without departing from such principles.

What is claimed is:

1. A container for a part such as a round of ammunition, comprising an outer cylindrical jacket having a closed bottom and an open top with an interior wall, an inner lining positioned on the interior of said inner wall and having an end face at one end spaced from the top and defining a stop, said jacket having an interior wall with a concave encircling bead defined into said interior wall at a spaced location from the top, and an elastic safety ring in said bead which projects inwardly beyond the interior wall and forms a counter stop face disposed opposite to said lining stop and holding said lining in a fixed axial position in said jacket.

2. A container according to claim 1, wherein said safety ring comprises a rubber material.

3. A container according to claim 2, wherein said safety ring comprises a rubber of a Shore hardness of 80° to 90°.

4. A container according to claim 1, including a removable cover closing the top thereof, said bead being spaced from said removable cover on the interior of said jacket.

5. A container according to claim 1, wherein said inner lining is retained between said safety ring and said bottom, said bottom comprising a fixed bottom.

6. A container according to claim 1, wherein said inner lining comprises cardboard material and said outer jacket comprising a sheet metal material.

7. A container according to claim 1, wherein said container is a circularly cylindrical part having a bottom with an inwardly defined recess, an ammunition part stored in said container including an encircling resilient pad at a lower end, an additional liner on the inside of said liner having an end face engaged on the bottom and an opposite end face defining a stop for said pad, a cover closing the top of said container and a resilient pad disposed between the ammunition part and said cover, said container having exterior rings flaring outwardly from the exterior of said container jacket located at the upper portion thereof and facing toward said top and at the lower portion thereof facing toward said bottom and constructed of a size to facilitate stacking of said containers.

8. Apparatus according to claim 1 wherein said outer jacket comprises a sheet metal material and is of constant thickness.

* * * * *